US006995363B2

(12) United States Patent
Donegan et al.

(10) Patent No.: US 6,995,363 B2
(45) Date of Patent: Feb. 7, 2006

(54) REDUCTION OF MATRIX INTERFERENCE FOR MALDI MASS SPECTROMETRY ANALYSIS

(75) Inventors: Michael P. Donegan, Charlton, MA (US); Andrew J. Tomlinson, Wayland, MA (US); Perumanath H. Nair, Shrewsbury, MA (US); Peter Juhasz, Natick, MA (US)

(73) Assignees: Applera Corporation, Framingham, MA (US); MDS Inc., Concord (CA)

( * ) Notice: Subject to any disclaimer, the term of this patent is extended or adjusted under 35 U.S.C. 154(b) by 114 days.

(21) Appl. No.: 10/914,395

(22) Filed: Aug. 9, 2004

(65) Prior Publication Data

US 2005/0040328 A1 Feb. 24, 2005

Related U.S. Application Data

(60) Provisional application No. 60/496,746, filed on Aug. 21, 2003.

(51) Int. Cl.
*H01J 49/04* (2006.01)

(52) U.S. Cl. ..... 250/288; 250/287; 250/292; 250/294; 250/299; 250/300; 428/416; 428/418; 428/420; 428/428; 428/429; 428/432; 428/433; 428/434; 428/435; 428/438; 428/442; 428/445; 428/446; 428/447; 428/448; 428/450

(58) Field of Classification Search ..... 250/281, 250/282, 287, 288, 292, 294, 299, 300; 428/411.1, 428/414, 416, 418, 420, 428–430, 432–435, 428/438–442, 444–450, 457, 461, 475.8, 428/476.1–6

See application file for complete search history.

(56) References Cited

U.S. PATENT DOCUMENTS

| | | | | | |
|---|---|---|---|---|---|
| 5,595,636 | A | * | 1/1997 | Franzen | 204/464 |
| 5,770,860 | A | * | 6/1998 | Franzen | 250/288 |
| 6,077,680 | A | * | 6/2000 | Kem et al. | 435/7.24 |
| 6,265,716 | B1 | * | 7/2001 | Hunter et al. | 250/288 |
| 6,287,872 | B1 | * | 9/2001 | Schurenberg et al. | 436/181 |
| 6,288,390 | B1 | * | 9/2001 | Siuzdak et al. | 250/288 |
| 6,635,489 | B2 | * | 10/2003 | Whitney | 436/86 |
| 6,677,307 | B2 | * | 1/2004 | Twardzik et al. | 514/12 |
| 6,746,775 | B1 | * | 6/2004 | Boire et al. | 428/432 |
| 6,777,187 | B2 | * | 8/2004 | Makarov et al. | 435/6 |
| 6,825,045 | B2 | * | 11/2004 | Haglund et al. | 436/174 |
| 6,825,466 | B2 | * | 11/2004 | Mordekhay | 250/288 |
| 2002/0051738 | A1 | * | 5/2002 | Schurenberg et al. | 422/102 |
| 2003/0111600 | A1 | * | 6/2003 | Thomson et al. | 250/288 |

(Continued)

FOREIGN PATENT DOCUMENTS

| | | | |
|---|---|---|---|
| GB | 002391066 A | * | 7/2003 |
| WO | WO 02/096541 A1 | | 5/2002 |

OTHER PUBLICATIONS

Donegan et al., "Controlling matrix suppression for matrix-assisted laser desorption/ionization analysis of small molecules", Rapid Commun. Mass Spectrom. 2004, vol. 18, pp. 1885–1888.*

(Continued)

*Primary Examiner*—John R. Lee
*Assistant Examiner*—Bernard E. Souw
(74) *Attorney, Agent, or Firm*—Andrew T. Karnakis

(57) ABSTRACT

A MALDI plate suitable for MS or MS-MS analysis provided with a composite coating that comprises a hydrophobic coating and a thin layer coating of a mixture of a MALDI matrix material and an intercalating agent such as a polymer is disclosed. A MALDI plate produced in accordance with the present teachings is useful for suppression of matrix ions in the low mass region (<1,000 daltons) of a MALDI-MS spectrum.

12 Claims, 8 Drawing Sheets

U.S. PATENT DOCUMENTS

| | | | | |
|---|---|---|---|---|
| 2004/0021071 | A1 * | 2/2004 | Mordekhay | 250/288 |
| 2004/0023410 | A1 * | 2/2004 | Stacey | 436/173 |
| 2004/0084615 | A1 * | 5/2004 | Schurenberg | 250/288 |
| 2004/0229049 | A1 * | 11/2004 | Boire et al. | 428/432 |

OTHER PUBLICATIONS

Vorm et al, "Improved Resolution and Very High Sensitivity in Maldi TOF of Matrix Surfaces Made by Fast Evaporation", Analytical Chemistry, 1994, vol. 66, No. 19, 3281–3287.

Guo et al, "A Method for the Analysis of Low–Mass Molecules by Maldi–TOF Mass Spectrometry", Analytical Chemistry, 2002, vol. 74, No. 7, 1637–1641.

Liu et al, "Use of a Nitrocellulose Film Substrate in Matrix-Assisted Laser Desorption/Ionization Mass Spectrometry for DNA Mapping and Screening", Analytical Chemistry, 1995, vol. 67, No. 19, 3482–3490.

Landry et al., "A Method for Application of Samples to Matrix–Assisted Laser Desorption Ionization Time–ofFlight Targets That Enhances Peptide Detection", Analytical Biochemistry, 279, 1–8 (2000).

Jacobs et al., "Enhancement of the Quality of MALDI Mass Spectra of Highly Acidic Oligosaccharides by Using a Nafion–Coated Probe", Analytical Chemistry, 2001, vol. 73, No. 3, 405–410.

Miliotis et al, "Ready–made matrix–assisted laser desorption/ionization target plates coated with thin matrix layer for automated sample deposition in high–density array format", Rapid Communications in Mass Spectrometry, 2002, 16, 117–126.

Sun et al, "Use of nitrocellulose films for affinity–directed mass spectrometry for the analysis of antibody/antigen interactions", Rapid Communications in Mass Spectrometry, 2001, 15, 1743–1746.

Jonsson et al., "Plasma Desorption Mass Spectrometry of Peptides and Proteins Adsorbed on Nitrocellulose", Analytical Chemistry, 1986, 58, 1084–1087.

* cited by examiner

REDUCTION OF MATRIX INTERFERENCE FOR MALDI MASS SPECTROMETRY ANALYSIS

PRIORITY AND RELATED APPLICATIONS

This application claims priority from U.S. Provisional Patent Application No. 60/496,746, filed Aug. 21, 2003, which is incorporated herein in its entirety by reference.

INTRODUCTION

The present teachings relate to a plate useful for matrix-assisted laser desorption ionization (MALDI) mass spectrometry analysis of molecules and a process for making the plate. More specifically, the present teachings relate to a MALDI plate useful in the analysis of small molecules (molecular mass <1000 daltons).

Mass spectrometry measurement of large biomolecules such as DNA, peptides and proteins using MALDI processes is standard methodology. However, for the analysis of small molecules that are typically less than 1,000 daltons the MALDI ionization technique has not been fully utilized. One difficulty in conducting MALDI analysis of small molecules is that laser ablation of sample spots also causes the formation of matrix ions that are detected in the low mass region of the collected mass spectrum, the same mass range in which small analytes would be detected. Further interferences are also detected in this mass range and are due to the high affinity of matrix ion with alkali metals, and the preponderance of matrices to form clusters that are also ionized and detected. These clusters contain a multiplicity of the matrix molecules, with many also containing a multiplicity of alkali metal ions. Ultimately, the low mass region (below 1,000 daltons) of MALDI generated mass spectra is extremely complex, making the detection of small molecule analytes difficult.

SUMMARY

In accordance with various embodiments, a MALDI plate suitable for MS analysis is provided with an integral hydrophobic coating, and is adapted to be subsequently coated with a thin film of a mixture of a MALDI matrix material and an intercalating agent such as a polymer. A MALDI plate produced in accordance with the present teachings is useful for suppression of matrix ions in the low mass region (<1,000 daltons) of a MALDI-MS spectrum, an attribute that makes such a MALDI plate particularly useful for MALDI-MS analysis of small molecules such as drugs, putative therapeutics, their metabolites and the like, whether presented as pure solutions or extracted from biological matrices such as urine, bile, feces, or serum.

These and other features of the present teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

DESCRIPTION OF VARIOUS EMBODIMENTS

Figure 1A:
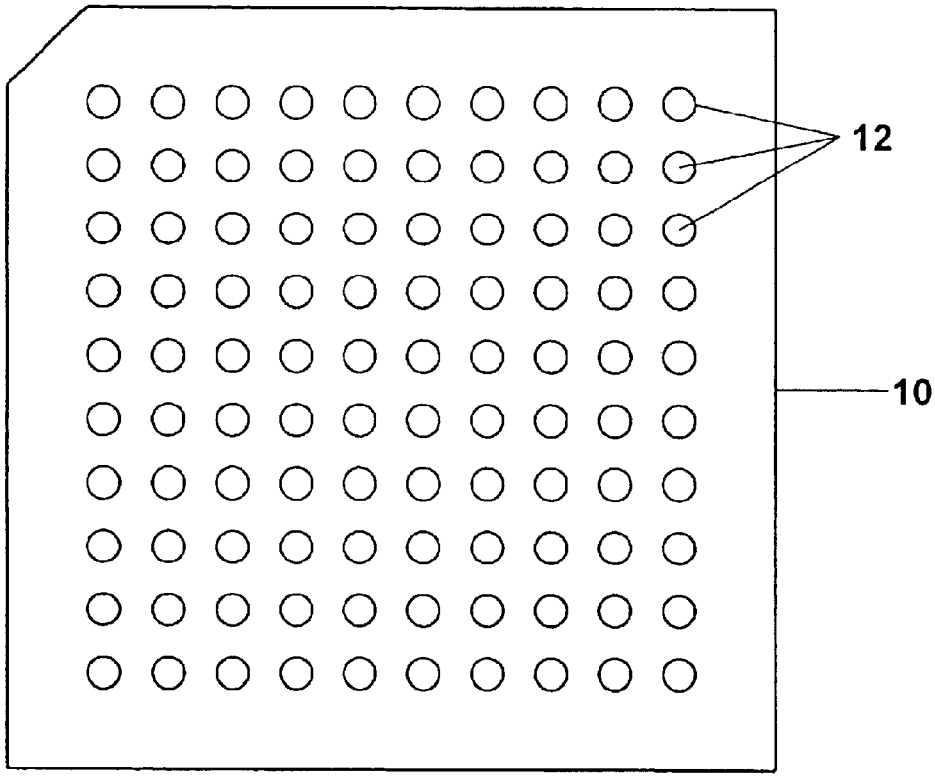
FIG. 1*a* is a plan view of a MALDI plate in accordance with the present teachings.

The need for high throughput methodologies for analysis of small molecule analytes, such as putative drug molecules, that provide both qualitative and quantitative information regarding the compound of interest has grown substantially in the pharmaceutical laboratory in recent years. Currently, methodologies for the analysis of these molecules are based upon the use of tandem mass spectrometry (also known as MS/MS) and typically use electrospray ionization (ESI) or atmospheric pressure ionization (APCI) to form ions corresponding to the analytes of interest. These ion sources are generally used with mass spectrometers such as quadrupole, ion trap, and hybrid quadrupole time of flight analyzers (Q-TOF).

MS analysis of small molecule samples using the methodologies described above is generally a serial process, with each sample analysis being carried out on the minute time scale. Such MS analysis is complicated by the fact that the analysis is usually performed in conjunction with rapid chromatographic separations that are on line with the mass spectrometry measurements. Compounding that time scale is the additional need for the use of several blank and quality control samples as well as the time required to develop reproducible chromatographic methods. Quality control of collected data to ensure no carry over of analytes from previous samples increases the time of analysis.

Time of flight mass spectrometers (TOF-MS), particularly those using MALDI ionization, when used for small molecule analysis offers the advantage of speed and enables analysis of sample mixtures in seconds rather than minutes. Parallel preparation of samples for subsequent analysis by MALDI TOF-MS can lead to increased sample throughput, and the use of single-use devices having small chromatographic beds for sample purification can eliminate analyte carryover from one sample to another. Use of disposable MALDI sample supports reduces the need for extensive quality assessments of collected data and also eliminates analyte carryover from one sample to another, thereby reducing cost and increasing sample throughput.

In accordance with various embodiments, a MALDI plate having appropriate electrical conductivity with matrix ion suppressing capability is provided. At least within the sample spotting region or target surface of the plate a hydrophobic coating can be applied, over at least a portion of which a matrix intercalated material is applied that can be, for example, a mixture of alpha cyano-4-hydroxy cinnamic acid (αCHCA) and an intercalating agent that can be a polymer, for example, nitrocellulose. Plates can be prepared by first applying the hydrophobic coating to the plate surface. Such a hydrophobic coating serves to reduce droplet spreading of the analyte sample and matrix preparation. In various embodiments, the hydrophobic coating can be an integral coating. By an integral coating we mean herein a physical coating on a substrate created by the interaction of one or more forces such as hydrophobic, ionic, van der Walls forces and the like that inhibit separation of the integral coating such that the coating cannot be pulled off the substrate intact, rather the coating is typically removed by chemical treatment (e.g., by use of solvents) or by mechanical means (e.g., abrasive treatments).

Suitable hydrophobic materials for coatings for preparation of a MALDI plate in accordance with various embodiments are described in co-pending U.S. patent application Ser. No. 10/227,088, whose disclosure is hereby incorporated by reference. In the event that there are any differences or contradictions between this incorporated reference and the present application, including but not limited to defined terms, term usage, described techniques, or the like, this application controls. Briefly, synthetic waxes (e.g., paraffin waxes), natural waxes (such as bees wax) lipids, esters, organic acids, silicon oils or silica polymers can be useful agents for forming the hydrophobic coating. These substances can be applied to the MALDI plate either as pure substances or in mixtures with each other or as parts of commercially available chemical compositions such as metal polishing pastes or vegetable oils. In various embodiments, the application of metal polish is effective for creating a desirable hydrophobic surface in accordance with the present teachings.

The hydrophobic coating helps focus the sample droplet into a smaller area, thereby establishing an effective means of increasing the concentration of sample components on the plate and also assisting in automatic positioning of the laser. Following formation of the hydrophobic coating, the plate can be coated with a mixture of a matrix material and an intercalating agent such as a polymer in a solvent in which both the intercalating agent and the matrix material are soluble, and we have found that this additional coating serves to suppress matrix ion formation. While not intending to be bound to any particular theory as to why these results are obtained, from observation the sample spots are noticeably smaller, thus in addition to concentrating the sample spot into a smaller area, the ratio of matrix to sample analyte is much lower within the reduced sample spot. This more ideal matrix to analyte ratio leads to favorable ionization conditions thereby promoting primarily ionization of the analyte Suitable matrix molecules can comprise those typically used for MALDI-MS analysis such as αCHCA, dihydroxybenzoic acid (DHB), Sinapinic acid, Dithranol, porphyrins and the like. Suitable polymer compositions can comprise nitrocellulose, polycarbonate, cellulose acetate and the like. In various embodiments, nitrocellulose can be mixed with αCHCA in acetone and this solution can be used to form a thin film coating over at least the sample target area on the hydrophobic coated plate. Matrix and polymer concentrations of between 0.25 and 10 mg/ml of each component have been demonstrated to provide suppression of matrix signals in observed MALDI-MS data. In various embodiments, matrix and polymer concentrations of 0.25 to 5 mg/ml of each component can be used. In various embodiments, matrix and polymer concentrations of 0.5 to 2.5 mg/mL can be used. In various embodiments, matrix and polymer concentrations of 1 to 2 mg/mL can be used.

In various embodiments, the composite coating (hydrophobic coating and matrix intercalated polymer) can form a thin layer (e.g., a monolayer) on the plate surface. After the composite coating is applied to the plate, a droplet of an analyte solution can be applied directly to the surface and allowed to evaporate. When sample spots were irradiated with a laser to create desorption and ionization of analytes of interest, peaks corresponding to matrix material and related adducts were not present in the collected spectra. The result produced "clean" spectra in the low mass range that enhanced the ability to detect the desired small molecule analytes due to the lack of interfering matrix peaks. We have found the technology described in the present teachings can be useful for collection of both MS and MS/MS MALDI data for small molecule analytes. A significant benefit of matrix ion suppression in MALDI-MS/MS analysis of a small molecule analyte is observed when the molecule of interest has the same or close to the same molecular mass as a matrix ion. Suppression of that matrix ion allows only the desired analyte to be fragmented, and the product ion spectrum generated to represent only the molecule of interest, with minimal to no contributions from the matrix ion of similar mass to charge ratio.

Methods for coating the plate with matrix material and intercalating polymer solution comprise those known to artisans for making thin film coatings and can comprise techniques such as spin coating, dip coating, roll coating, and the like.

Figure 1B:
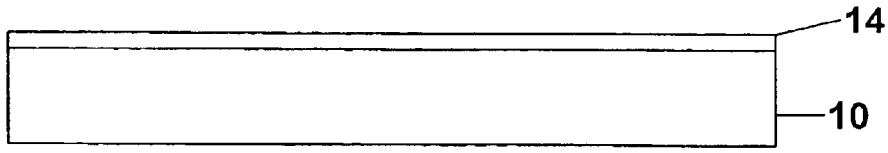
FIG. 1*b* is a cross section of the MALDI plate shown in FIG. 1*a*.

FIG. 1*a* shows a MALDI sample plate 10 in accordance with the present teachings with a plurality of sample spots 12 on the surface to be analyzed. The plate can be made of a conductive material such as stainless steel and, while shown as a square, can be any suitable geometry or size appropriate for the MS analysis to be conducted. FIG. 1*b* is a cross sectional view of the plate 10. The composite coating 14 that can comprise the hydrophobic coating and the intercalating agent mixture can cover at least the sample target area and typically can cover the entire top surface of the plate 10. The composite coating 14 is exaggerated to show it as a layer of finite thickness, but typically the composite coating can be a thin layer such as a monolayer applied to the stainless steel MALDI plate.

The foregoing description as well as the examples below describe preparation and use of a MALDI plate that can be used for suppression of peaks corresponding to matrix signals in the low mass region (<1,000 daltons) of MALDI-MS spectral data.

EXAMPLES

Aspects of the present teachings may be further understood in light of the following examples, which should not be construed as limiting the scope of the present teachings in any way.

Example 1

Preparation of Matrix Suppressing MALDI Plate

The target surface of a conventional stainless steel MALDI plate was polished with a commercially available POL metal polish in accordance with the teachings of U.S. patent application Ser. No. 10/227,088. On completion of this process in which the metal polish was applied and the MALDI plate was buffed to a shine, components of the metal polish remained on the plate surface to form an integral hydrophobic coating. The polymer/matrix coating solution was prepared by dissolving alpha cyano-4-hydroxy cinnamic acid and nitrocellulose in acetone (approximately 50 mg of each component was weighed into a glass container and solubilized in 50 mL of acetone). The matrix intercalated polymer layer was formed by application of 100 μL of this solution onto the target area of a metal polished MALDI plate. The plate was then immediately spun at 8,000 RPM for 20 seconds, and residual solvent evaporated to produce a thin coating on top of the hydrophobic coating on the plate surface that is ready to accept deposition of samples that are dissolved in a variety of solvents.

Example 2

Figure 2A:
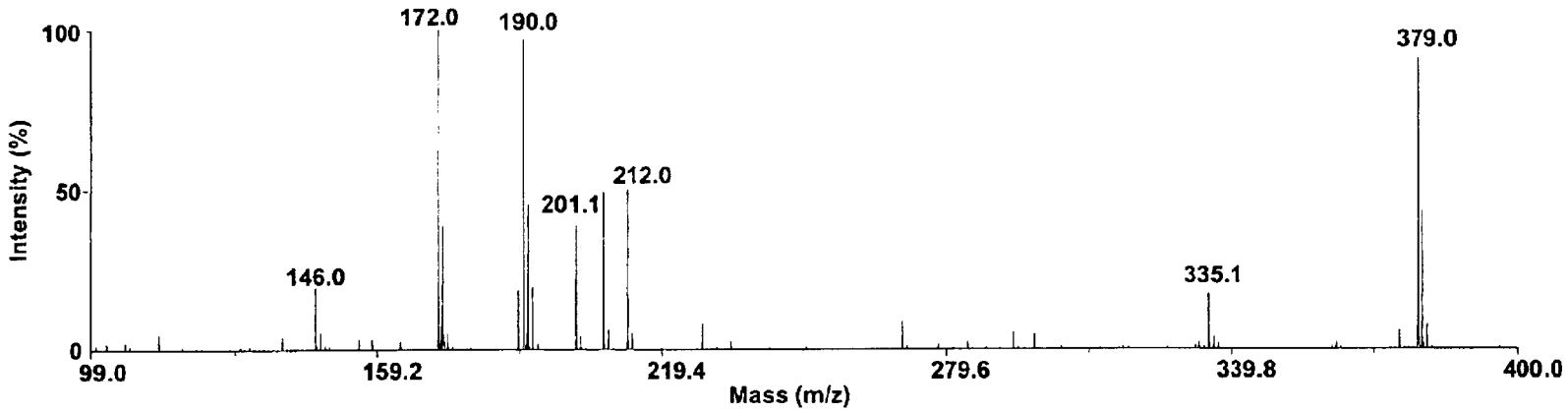
FIG. 2*a* depicts a MALDI TOF-MS spectrum for a sample of tetrahydrozoline spotted using a conventional MALDI dry droplet sample preparation technique.
Figure 2B:
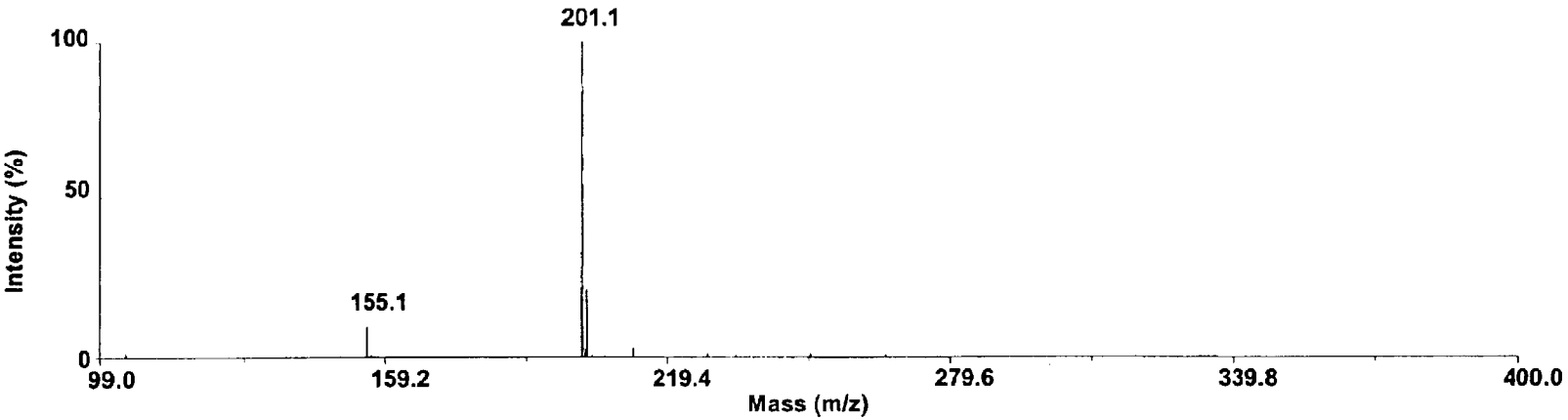
FIG. 2*b* depicts a MALDI TOF-MS spectrum of a further aliquot of the same sample of tetrahydrozoline spotted on a thin film of a matrix intercalated polymer MALDI plate prepared according to the present teachings.

FIGS. 2*a* and 2*b* illustrate how the use of the polymer coated target plate reduces matrix ion interferences. The conventional MALDI dried droplet technique, as described within the teachings of U.S. patent application Ser. No. 10/227,088, is represented in FIG. 2*a*. In this example, a 0.5 μL aliquot of a 100 ng/mL tetrahydrozoline (m/z 201) solution in 60% acetonitrile was applied to a dried droplet of 7 mg/mL α cyano-4-hydroxycinnamic acid and analyzed on a Voyager-DE™ PRO workstation (Applied Biosystems). Matrix ions are the dominant species in this MALDI-TOF-MS spectrum as can be readily observed at m/z 172, 190, 212, 335 and 379. FIG. 2*b* represents analysis of a further 0.5 μL aliquot from the same sample of tetrahydrozoline applied to a matrix intercalated polymer coated MALDI plate made by the procedure given in Example 1. In this spectrum, most of the matrix signal was eliminated, while the analyte signal at m/z 201 is clearly distinguished.

Example 3

Figure 3A:
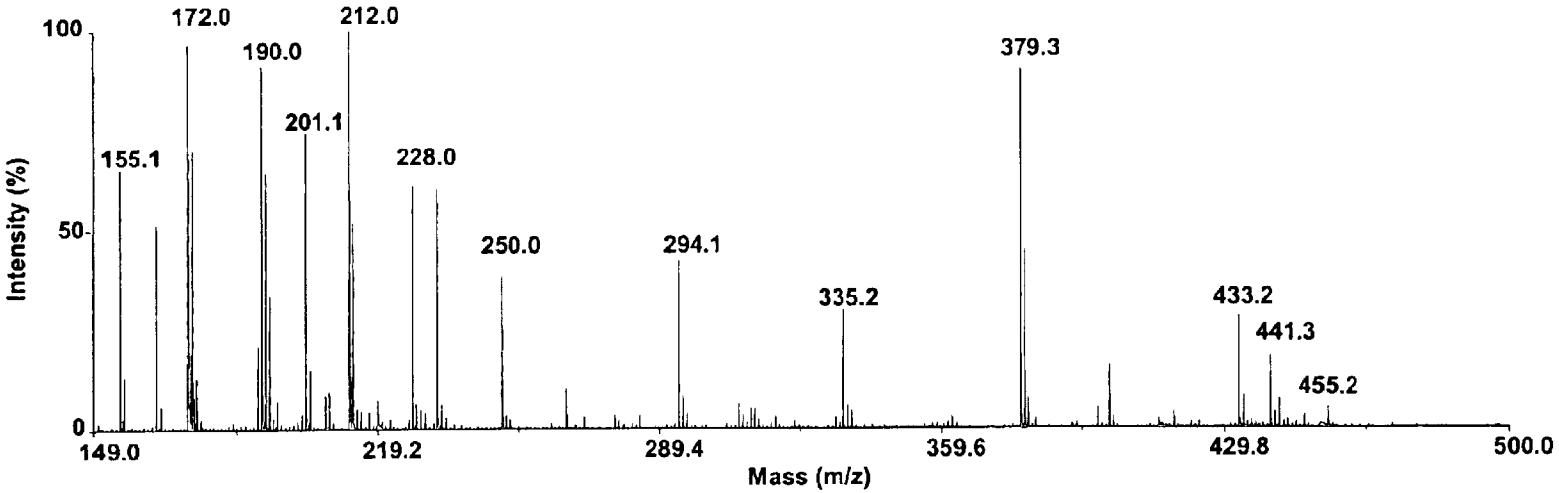
FIG. 3*a* depicts a MALDI TOF-MS spectrum for a sample of verapamil spotted using a conventional MALDI dry droplet sample preparation technique.
Figure 3B:
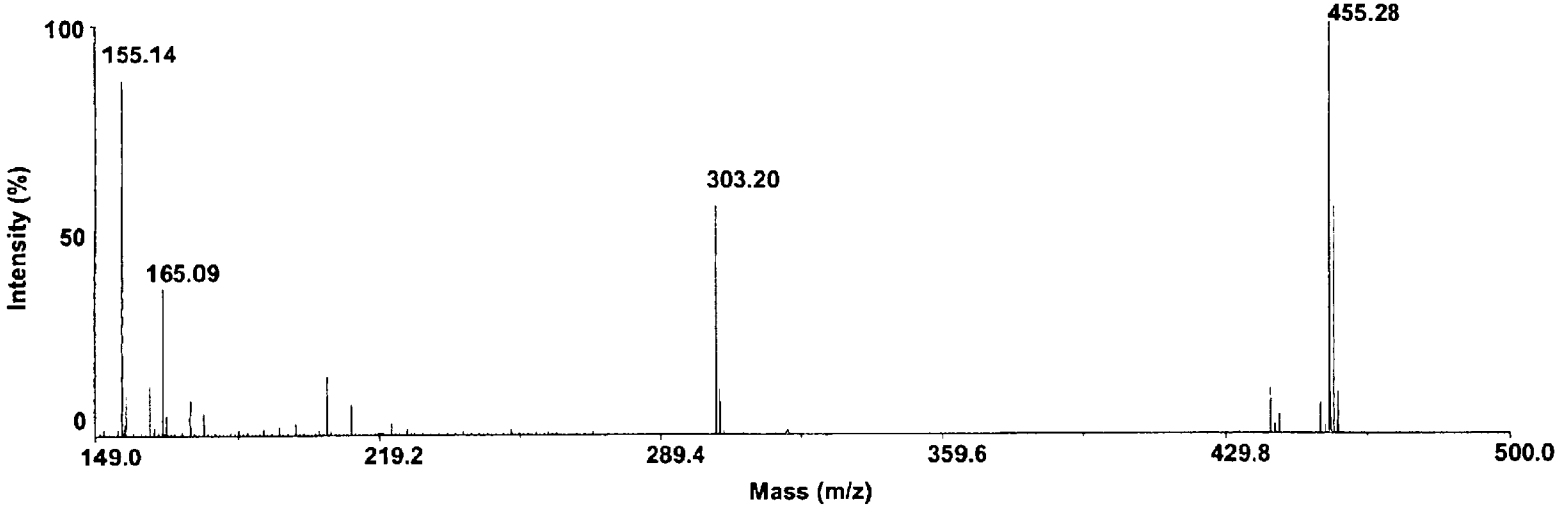
FIG. 3*b* depicts a MALDI TOF-MS spectrum of a further aliquot of the same sample of verapamil spotted on a thin film of a matrix intercalated polymer MALDI plate prepared according to the present teachings.

FIGS. 3*a* and 3*b* further illustrate the suppression effect observed when a different molecule was analyzed using a matrix intercalated polymer coated MALDI plate prepared as described in Example 1. The conventional MALDI dried droplet technique is represented in FIG. 3*a*. In this example, a 0.5 μL aliquot of a 100 ng/mL verapamil (m/z 455) solution in 80% acetonitrile was applied to a dried droplet of 7 mg/mL α cyano-4-hydroxycinnamic acid and analyzed on a Voyager-DE™ PRO workstation (Applied Biosystems). Matrix ions observed at m/z 172, 190, 212, 335, 379 and 441 dominate this MALDI-TOF-MS spectrum. FIG. 3*b* represents a further 0.5 μL aliquot from the same sample of verapamil solution applied to the polymer coated MALDI target plate made by the procedure given in Example 1. In this spectrum, most of the matrix signal was eliminated, while the analyte signal at m/z 455 is clearly distinguished.

Example 4

Figure 4A:
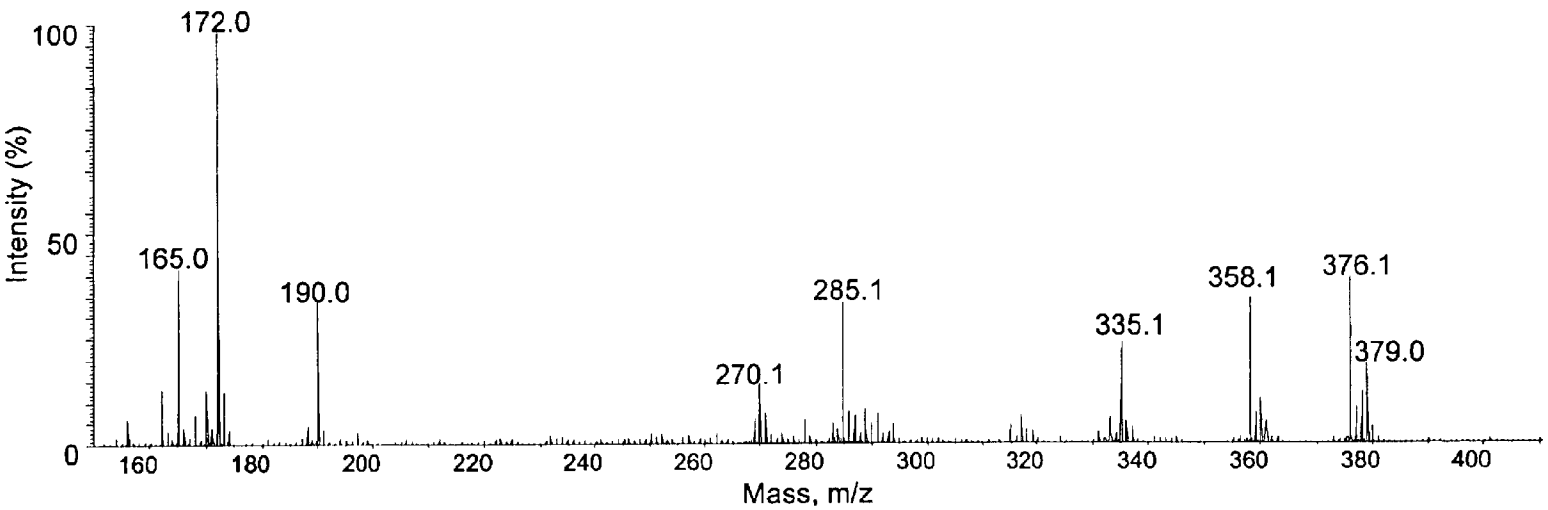
FIG. 4*a* depicts a MALDI TOF-MS spectrum for a sample of haloperidol spotted using a conventional MALDI dry droplet sample preparation technique.
Figure 4B:
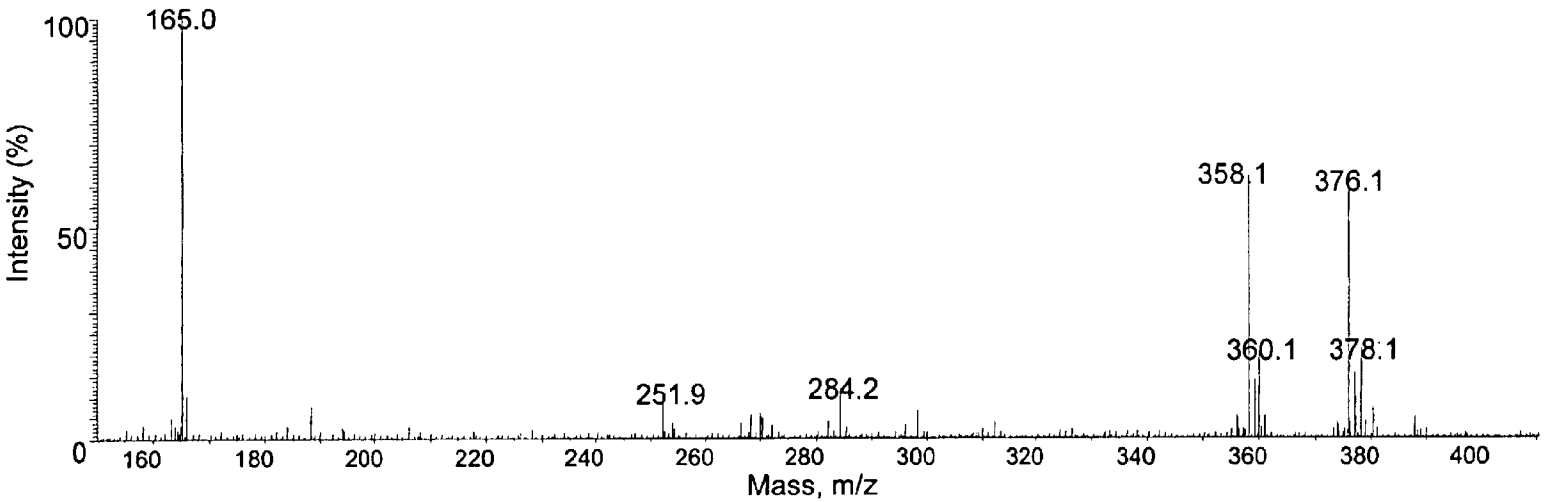
FIG. 4*b* depicts a MALDI TOF-MS spectrum of a further aliquot of the same sample of haloperidol spotted on a thin film of a matrix intercalated polymer MALDI plate prepared according to the present teachings.

FIGS. 4*a* and 4*b* further illustrate the suppression effect observed when yet another molecule was analyzed using a matrix intercalated polymer coated MALDI plate prepared as described in Example 1. The conventional MALDI dried droplet technique is represented in FIG. 4*a*. In this example, a 0.5 μL aliquot of a 1000 ng/mL haloperidol (m/z 376) solution in 80% acetonitrile was applied to a dried droplet of 7 mg/mL α cyano-4-hydroxycinnamic acid and analyzed in TOF-MS mode on a QSTAR® XL system equipped with an oMALDI™ 2 source (Applied Biosystems). Matrix ions observed at 172, 190, 335 and 379 dominate this MALDI-TOF-MS spectrum. FIG. 4*b* represents a further 0.5 μL aliquot from the same sample of haloperidol solution applied to the polymer coated MALDI target plate made by the procedure given in Example 1. In this spectrum, most of the matrix signal was eliminated, while the analyte signal at m/z 376 is clearly distinguished.

Example 5

Figure 5:
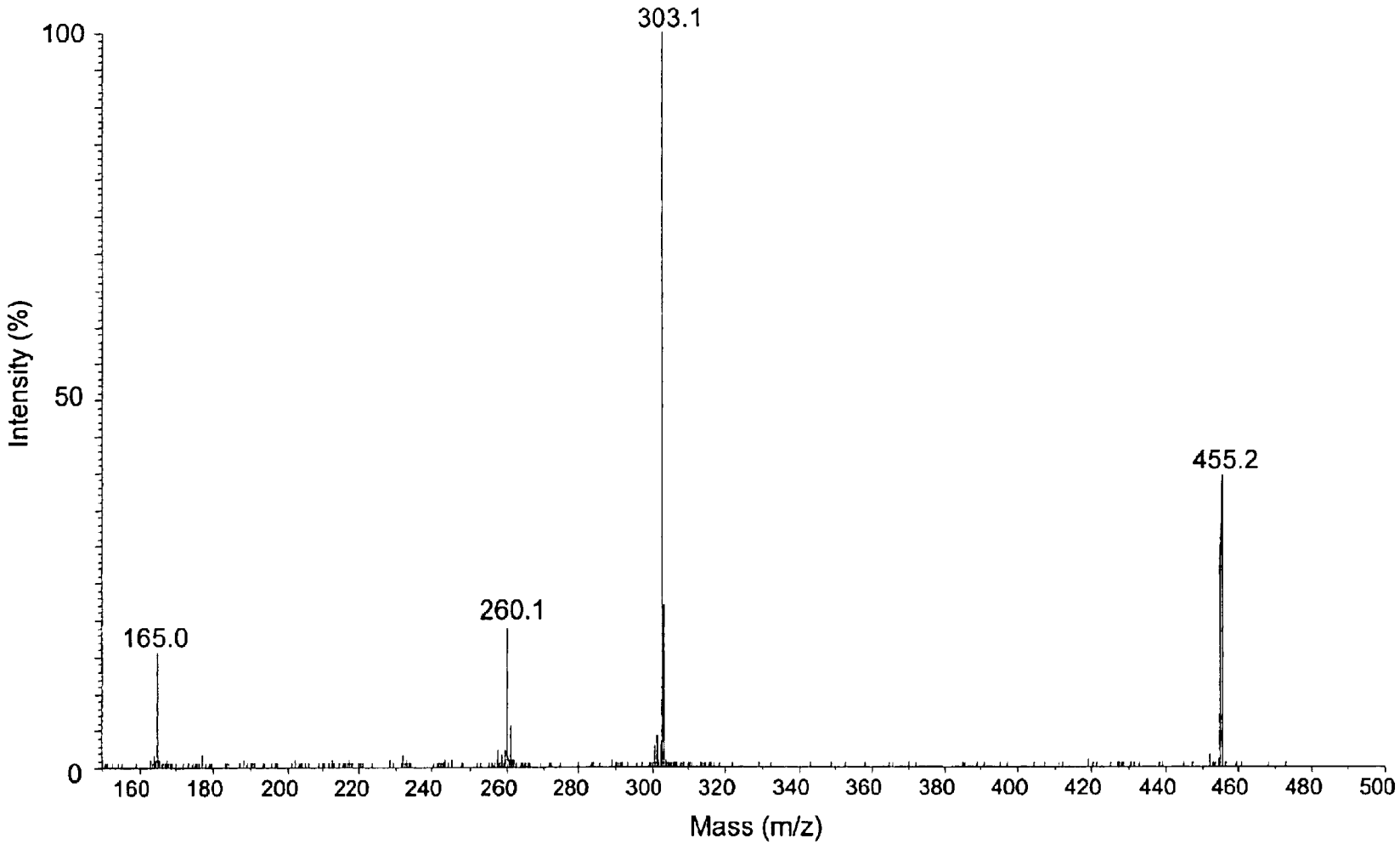
FIG. 5 depicts a MALDI QqTOF-MS/MS spectrum collected from a sample of verapamil spotted on a thin film of a matrix intercalated polymer MALDI plate prepared according to the present teachings.

FIG. 5 depicts the QqTOF-MSMS spectra collected using a QSTAR® XL system equipped with an oMALDI™ 2 source (Applied Biosystems) for a 0.5 μL aliquot of a 1000 ng/mL verapamil solution in 80% acetonitrile spotted on a matrix intercalated thin polymer film MALDI plate prepared according to the current teachings. This spectrum demonstrates no contamination by matrix fragment ions, and clear detection of analyte fragment ions in an MS/MS scan.

Example 6

Figure 6:
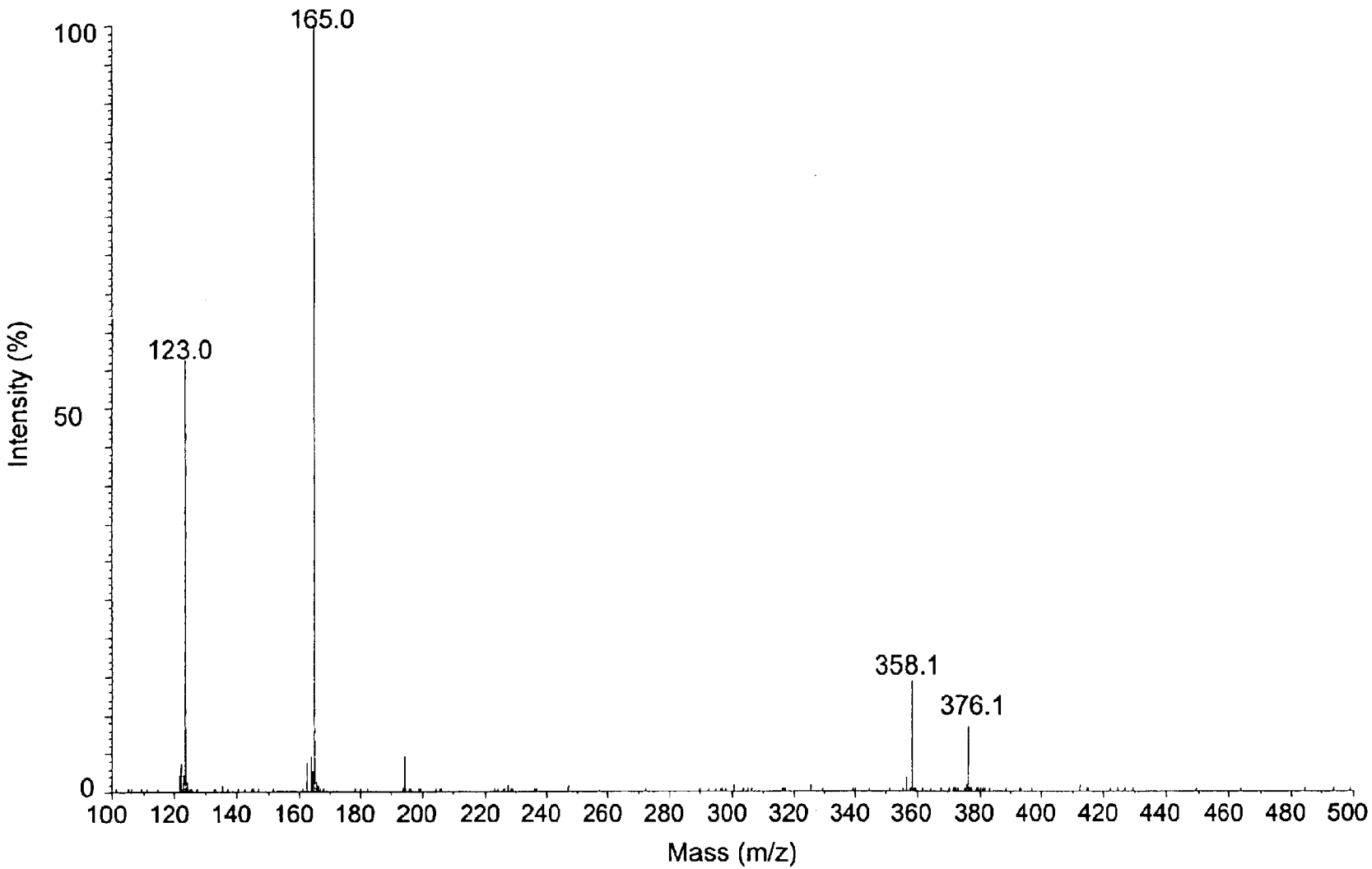
FIG. 6 depicts a MALDI QqTOF-MS/MS spectrum collected from a sample of haloperidol spotted on a thin film of a matrix intercalated polymer MALDI plate prepared according to the present teachings.

FIG. 6 depicts the QqTOF-MSMS spectra collected using a QStar® XL system equipped with an oMALDI™ 2 source (Applied Biosystems) for a 0.5 μL aliquot of a 1000 ng/mL haloperidol solution in 80% acetonitrile spotted on a matrix intercalated thin polymer film MALDI plate prepared according to the current teachings. This spectrum demonstrates no contamination by matrix fragment ions, and clear detection of analyte fragment ions in an MS/MS scan.

Example 7

Figure 7A:
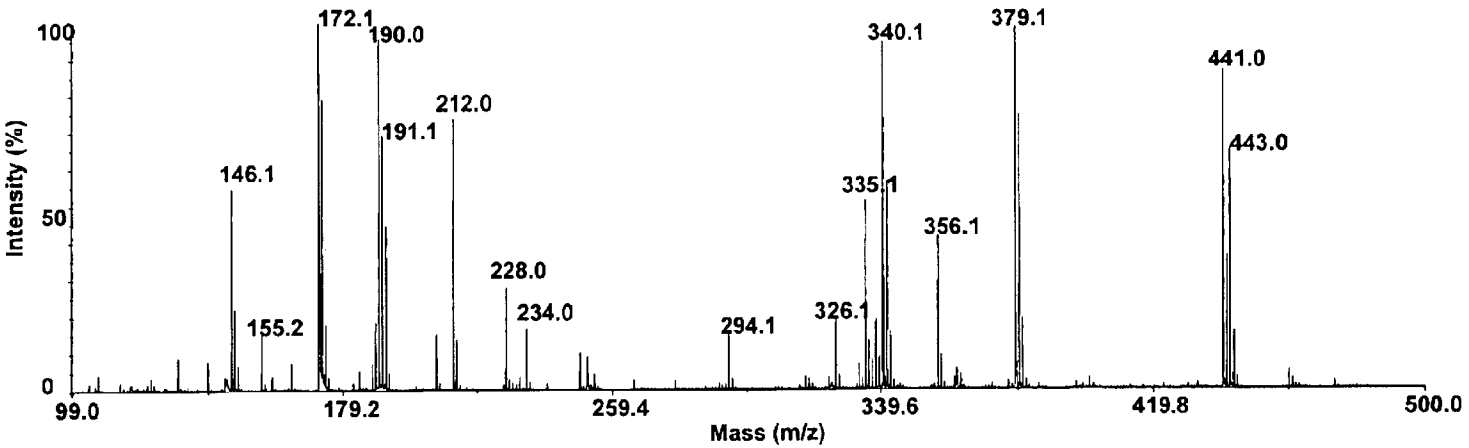
FIG. 7*a* depicts an LC-MALDI TOF-MS spectrum that was acquired from a sample of papaverine incubated in human hepatocytes and spotted using a conventional MALDI dry droplet sample preparation technique.
Figure 7B:
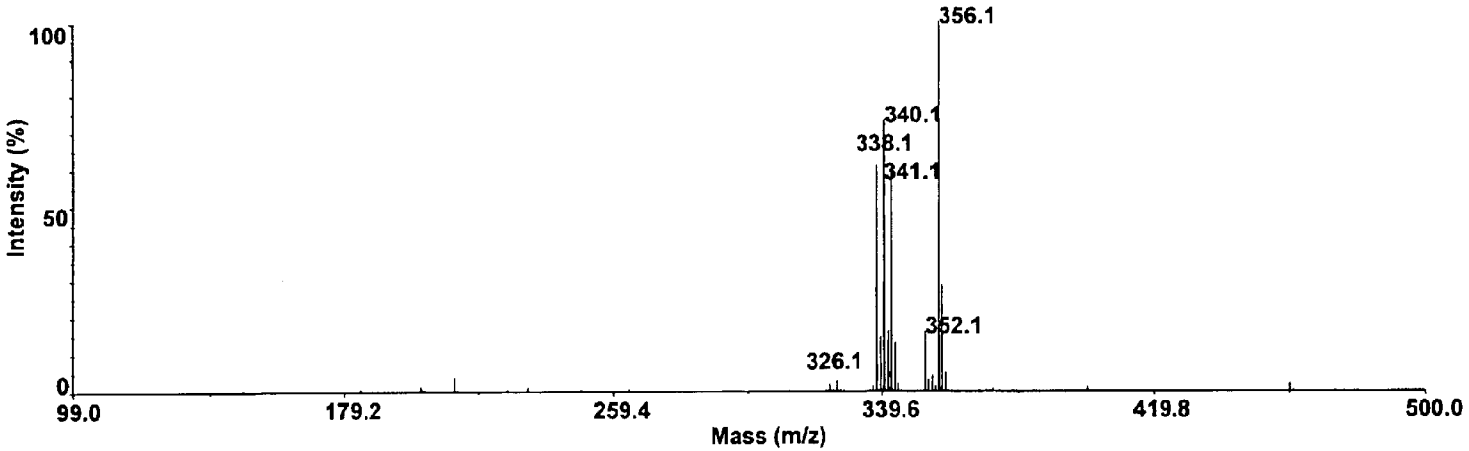
FIG. 7*b* depicts an LC-MALDI TOF-MS spectrum that was acquired from a sample of papaverine incubated in human hepatocytes and spotted on a thin film of a matrix intercalated polymer MALDI plate prepared according to the present teachings.

FIG. 7*a* depicts the conventional LC-MALDI acquisition of a 5 μL aliquot of 12.5 μM papaverine that was incubated with human hepatocytes. These spectra were collected in TOF-MS mode using a 4700 Proteomics Analyzer with TOF/TOF™ optics (Applied Biosystems). This spectrum clearly indicates that matrix ions are the dominant species in this sample and can be readily observed at m/z 172, 190, 212, 335, 379 and 441. The parent compound and several metabolites are also observed within this spectrum. The parent compound (m/z 340.1) was found in well 43, the demethylation metabolite (m/z 326.1) found in well 40, the hydroxylation metabolite (m/z 356.1) was found in well 44 and the hydroxylation/demethylation metabolite (m/z 341.1) was observed in well 45. As can be observed, none of these analyte signals are distinctive in comparison to that from the CHCA. When the above LC-MALDI experiment is repeated on the same sample of papaverine using the matrix intercalated thin polymer film MALDI plate prepared according to the current teachings as shown in FIG. 7*b*, the parent mass as well as the 3 metabolites are readily detected and identified since matrix ion interferences were eliminated.

Example 8

Figure 8A:
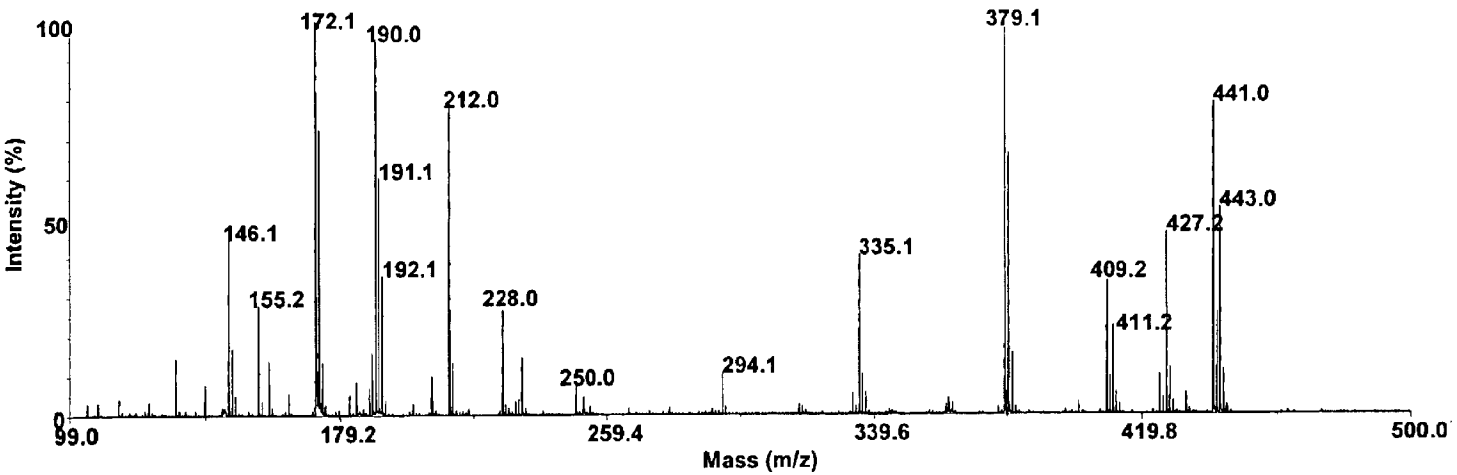
FIG. 8*a* depicts an LC-MALDI TOF-MS spectrum that was acquired from a sample of risperidone incubated in human hepatocytes and spotted using a conventional MALDI dry droplet sample preparation technique.
Figure 8B:
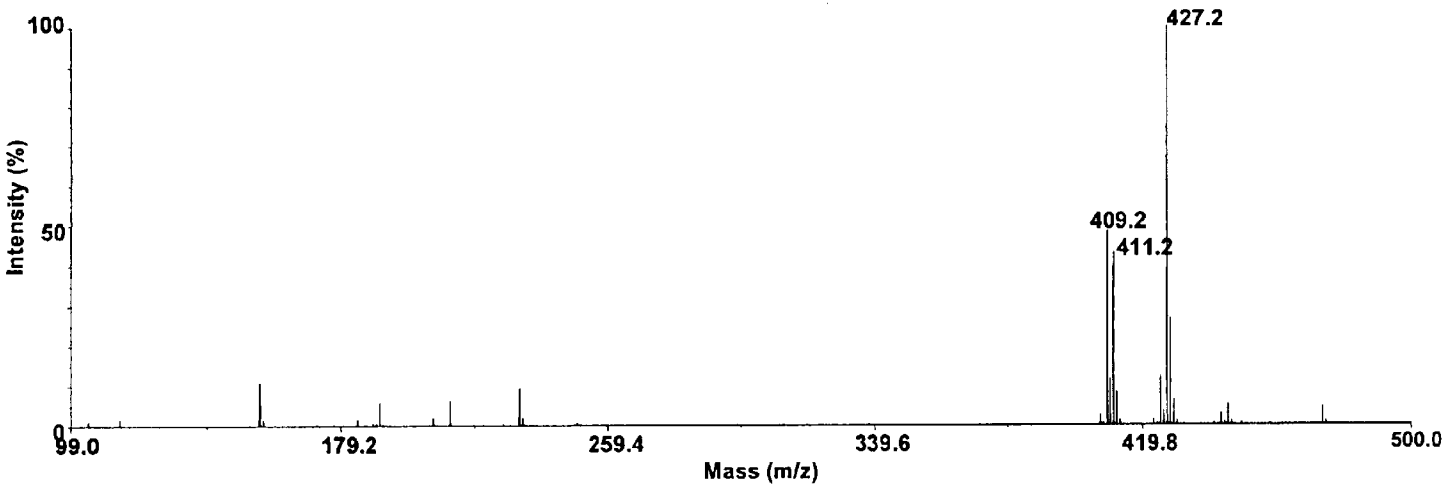
FIG. 8*b* depicts an LC-MALDI TOF-MS spectrum that was acquired from a sample of risperidone incubated in human hepatocytes and spotted on a thin film of a matrix intercalated polymer MALDI plate prepared according to the present teachings.

FIG. 8*a* depicts the conventional LC-MALDI acquisition of a 5 μL aliquot of 12.5 μM risperidone that was incubated in human hepatocytes. These spectra were collected in TOF-MS mode using a 4700 Proteomics Analyzer with TOF/TOF™ optics (Applied Biosystems). Matrix ions dominate this MALDI-TOF spectrum just as they did in the previous example. One can sort through the cluster of masses and identify the parent compound (m/z 411.2) as well as the hydroxylation metabolite (m/z 427.2) and the dehydrogenation metabolite (m/z 409.2). None of these analyte signals are distinctive in comparison to that from the CHCA. When we repeat the LC-MALDI experiment using the MALDI plate prepared according to the current teachings as shown in FIG. 8*b*, most of the matrix signal was eliminated, while the analyte signal at m/z 411 and the primary metabolite ions at m/z 427 and m/z 409 are clearly distinguished.

What is claimed is:

1. A sample plate for MALDI analysis comprising:

an electrically conductive substrate having a first surface, at least a portion of the first surface coated with a composite coating that comprises a hydrophobic coating and a coating of a thin film mixture of a matrix and an intercalating polymer.

2. The sample plate of claim 1 wherein the substrate is made of stainless steel.

3. The sample plate of claim 1 wherein the matrix is α cyano-4-hydroxycinnamic acid.

4. The sample plate of claim 1 wherein the intercalating polymer is nitrocellulose.

5. The sample plate of claim 1 wherein upon ionization by laser desorption matrix ions below a mass to charge ratio of 1,000 daltons are suppressed.

6. The sample plate of claim 1 wherein the hydrophobic coating comprises an integral coating of any one of a paraffin composition, lipid, fatty acid, ester, silicon oil or wax or combinations thereof, or a polish that comprises mixtures of the foregoing that are designed to clean and protect metal surfaces.

7. The process for making a sample plate for MALDI MS or MS-MS analysis comprising:

forming a hydrophobic coating on a first surface of an electrically conductive substrate; and forming a second coating on the first surface and the hydrophobic coating with a mixture in solution containing a matrix and an intercalating polymer to form a composite coating on the substrate.

8. The process of claim 7 where the matrix and the intercalating polymer mixture is a mixture of α cyano-4-hydroxycinnamic acid and nitrocellulose, both components of the mixture at a concentration of between about 1 and 2 mg/mL.

9. The process of claim 8 where the matrix and the intercalating polymer mixture is a mixture of α cyano-4-hydroxycinnamic acid and nitrocellulose in acetone.

10. The process of claim 7 wherein the hydrophobic coating comprises an integral coating of any one of a paraffin composition, lipid, fatty acid, ester, silicon oil or wax or combinations thereof, or a polish that comprises mixtures of the foregoing that are designed to clean and protect metal surfaces.

11. The process of claim 7 wherein the electrically conductive substrate is stainless steel.

12. The process of claim 7 wherein upon ionization by laser desorption matrix ions below a mass to charge ratio of 1,000 daltons are suppressed.

* * * * *